United States Patent [19]

Kasai

[11] Patent Number: 4,945,614

[45] Date of Patent: Aug. 7, 1990

[54] BUCKLE ASSEMBLY

[75] Inventor: Kazumi Kasai, Namerikawa, Japan

[73] Assignee: Yoshida Kogyo K.K., Tokyo, Japan

[21] Appl. No.: 372,529

[22] Filed: Jun. 28, 1989

[30] Foreign Application Priority Data

Jun. 28, 1988 [JP] Japan ..... 63-84435[U]

[51] Int. Cl.[5] ..... A44B 11/25

[52] U.S. Cl. ..... 24/573.1; 24/194; 24/615

[58] Field of Search ..... 24/573, 453, 287, 289, 24/305, 607, 612, 615, 171, 194

[56] References Cited

U.S. PATENT DOCUMENTS

| | | | |
|---|---|---|---|
| 2,097,055 | 10/1937 | Bender . | |
| 2,138,542 | 11/1938 | Goldberg . | |
| 2,588,655 | 3/1952 | O'Neill . | |
| 3,656,211 | 4/1972 | Turner et al. | 24/194 |
| 4,150,464 | 4/1979 | Tracy | 24/615 |
| 4,559,679 | 12/1985 | Downey | 24/573 |
| 4,662,040 | 5/1987 | Terrell et al. | 24/615 |
| 4,688,337 | 8/1987 | Dillner et al. | 24/615 |
| 4,793,032 | 12/1988 | Crowle | 24/607 |
| 4,825,515 | 5/1989 | Wolterstorff, Jr. | 24/615 |

FOREIGN PATENT DOCUMENTS

| | | |
|---|---|---|
| 0055241 | 6/1982 | European Pat. Off. . |
| 0311042 | 4/1989 | European Pat. Off. . |
| 432148 | 7/1926 | Fed. Rep. of Germany . |
| 2539277 | 3/1977 | Fed. Rep. of Germany . |
| 62-24721 | 2/1987 | Japan . |

*Primary Examiner*—Victor N. Sakran

*Attorney, Agent, or Firm*—Hill, Van Santen, Steadman & Simpson

[57] ABSTRACT

A buckle includes a base consisting of a base plate having an open hole formed therein on the longitudinal one end side thereof and opposite guide grooves formed therein on both sides thereof, a socket consisting of a plate-shaped body having a projection with an aperture formed integrally therewith on an opposite end to a belt connecting portion thereof, the projection being fitted in the hole formed in the base plate, and a plug consisting of a plate-shaped base body adapted to be slidably moved along the guide grooves of the base and having resilient pieces formed one end thereof and engaged with the aperture of the socket in snap-fit fashion and disengaged therefrom, wherein the resistance to sliding of the plug on the base becomes large when the resilient pieces of the plug are located out of the hole formed in the base plate.

6 Claims, 5 Drawing Sheets

BUCKLE ASSEMBLY

BACKGROUND OF THE INVENTION

1. Field of the Invention

This invention relates to a buckle used for connection of belts attached to a helmet, a life jacket and a rucksack or the like.

2. Description of the Prior Art

Heretofore, as disclosed in a laid-open specification No. Sho 62-24721 of Japanese Utility Model Reg. Application, a buckle wherein a base connected to a first belt is connected by means of a plug to a socket connected to a second belt has been well known.

Stating more specifically, as shown in FIG. 1, a belt 2 connected to a first belt 1 consists of a base plate 3 having a hole 4 formed therein, and a socket 6 connected to a second belt 5 consists of a flat plate 7 having a U-shaped engaging projection 8 formed thereon so as to form an aperture 9 between the projection 8 and the flat plate 7. Further, a plug 11 connected to a third belt 10 is formed into a flat plate adapted to be inserted in the aperture 9. The arrangement is made such that the projection 8 is fitted in the hole 4, and the plug 11 is inserted in the aperture 9 of the projection 8 projecting from the base plate 3 of the base 2 to thereby connect the base 2 with the socket 6.

In this buckle, the base 2 can be detached from the socket 6 by pulling out the third belt 10 to draw out the plug 11 from the aperture 9.

In such a buckle, however, the plug 11 is inserted in the aperture 9 of the projection 8 to connect the base 2 with the socket 6. Since the plug 11 is merely a flat plate and is held only by the friction resistance between it and the aperture 9 so as not to be drawn out, the plug 11 is liable to be drawn out from the aperture 9, and hence the base 2 cannot be connected securely to the socket 6.

Further, when the base 2 is detached from the socket 6, the plug 11 is detached from the base 2. Therefore, when the plug 11 is inserted in the aperture 9 of the projection 8 on the base plate 3 of the base 2, positioning of the plug 11 relative to the aperture 9 is troublesome and requires much trouble for connecting the base 2 with the socket 6.

To solve this problem, the inventor of the present invention has filed a Japanese Utility Model Reg. Application for buckle wherein, as shown in FIG. 2, a base 2 is formed with guide grooves 12 along which a plug 11 is slidably fitted in, and the plug 11 is formed with a pair of resilient pieces 13, 13 so that the sliding movement of the plug 11 along the guide grooves 12 enables the pair of resilient pieces 13, 13 to make snap fit into or to be withdrawn from the aperture 9 of the engaging projection 8 of the socket 6.

In such a construction, since the plug 11 can be engaged securely with the aperture 9 so as not to slip out of it, and when the base 2 is detached from the socket 6 the plug 11 can be held on the base 2 and inserted and engaged with the aperture 9 by moving it along the guide grooves 12, a strong connection of the base 2 and the socket 6 can be achieved, and also the connecting operation of the base 2 and the socket 6 can be made readily.

In this buckle, however, since the plug 11 is slidably moved freely by a small force along the guide grooves 12, when the third belt 10 is pulled out in the direction shown by arrow so as to withdraw from the aperture 9, there is a possibility of the plug 11 striking against stopper portions 2a of the base 2, and the resultant reaction force causing the resilient pieces 13 to spring back to the position of the aperture 4, or the plug 11 sliding by its own weight. Therefore, upon connecting the base 2 and the socket 6 again, it is required to slidably move the plug 11 towards the stopper portions 2a to enable the engaging projection 8 to be fitted in the hole 4, thus making the connecting operation of the base 2 and the socket 6 troublesome.

SUMMARY OF THE INVENTION

The present invention has been made in view of the above-described circumstances, and it is an aim of the present invention to provide a buckle which can connect more firmly a base with a socket through a plug of which resilient pieces are positively inserted in position into an aperture of the socket so as to enable the base to be easily connected with the socket.

It is another aim of the present invention to provide a buckle which can prevent the plug from slipping out from the base, when the base is detached from the socket, so as not to cause the plug itself to spring buck or to slidably move the action of its own weight.

In order to realize the above described aims, according to a first aspect of the present invention, there is provided a buckle comprising: a base consisting of a base plate having a hole formed therein on the longitudinal one end side thereof, a portion for connecting a first belt, the first belt connecting portion being formed in the base plate on the other end side thereof, and opposite rising pieces formed integrally therewith on both sides thereof, each rising piece having an inward projection piece formed integrally with the rising piece on the uppermost part thereof so as to form a guide groove thereat; a socket consisting of a plate-shaped body having a portion for connecting a second belt, the portion being formed in the plate-shaped body on one end side thereof, and a projection formed integrally with the plate-shaped body on the other end side thereof, the projection being fitted in the hole formed in the base plate and having an aperture formed therein so as to be parallel to an upper surface of the plate-shaped body; and a plug consisting of a plate-shaped base body adapted to be slidably moved along the guide grooves formed at both sides of the base and having resilient pieces formed integrally therewith and extending from one end thereof, the resilient pieces being adapted to be engaged with the aperture of the socket in snap-fit fashion and disengaged therefrom, and further having a portion for connecting a third belt, the third belt connecting portion being formed in the plate-shaped base body on the other end side thereof; wherein the respective sliding portions of the base and the plug are arranged such that the resistance to sliding of the plug on the base becomes large when the resilient pieces of the plug are located out of the hole formed in the base plate of the base.

In order to realize the above-described aims, according to a second aspect of the present invention, there is provided a buckle as set forth in the first aspect wherein it is characterized in that the base plate of the base further has first, second and third grooves formed respectively in positions in the base plate at both side hands thereof, the grooves in each side being rectilinearly arranged at predetermined intervals in the longitudinal direction of the base plate, a first engaging portion formed between the first groove and the second groove, and a second engaging portion formed between the second groove and the third groove, and in that the plug is further provided with a pair of engaging pieces at both side hands of the plate-shaped base body thereof, respectively, each engaging piece being formed at a longitudinally intermediate portion of the plate-shaped base body and projecting downwards so as to be slidably inserted into the first, second and third grooves of the base plate and engaged with the first and second engaging portions of the base plate.

In order to realize the above-described aims, according to a third aspect of the present invention, there is provided a buckle as set forth in the first aspect wherein it is characterized in that the base plate further has first and second upward engaging projections formed respectively thereon at both side hands thereof, the engaging projections in each side being arranged in series and at predetermined intervals in the longitudinal direction of the base plate and upwardly projecting integrally from the upper surface of the base plate, and in that the plug is further provided with downward guide recesses formed in lower surfaces at both sides of the plate-shaped base body of the plug, each downward guide recess being slidably engaged with the first and the second upward engaging projections of the base, plate and engaging pieces formed in positions in the downward guide recesses, respectively, and integrally projecting downwards from the plate-shaped base body so as to engage with the first and the second upward engaging projections of the base plate.

In order to realize the above-described aims, according to a fourth aspect of the present invention, there is provided a buckle as set forth in the first aspect wherein it is characterized in that the base plate further base first and second engaging projections formed integrally on inward side faces of the inward projection pieces of the rising pieces thereof forming the guide grooves of the base, respectively, the engaging projections in each side being arranged in positions at predetermined intervals in the longitudinal direction of the base plate, and in that the plug is further provided with engaging pieces formed integrally in positions on both side and faces of the plate-shaped base body of the plug, respectively, so as to engage with the first and second engaging projections of the base plate.

In order to realize the above-described aims, according to a fifth aspect of the present invention, there is provided a buckle as set forth in the first aspect wherein it is characterized in that the plug is still further provided with an upward projection to facilitate the insertion of the plug into the aperture formed in the socket by holding the plug by user's fingers after the socket is engaged with the base, said upward projection being formed at one end of the plate-shaped base body.

Further, according to a sixth aspect of the present invention, there is provided a buckle as set forth in the second aspect wherein each of the first engaging portions has a substantially trapezoidal sectional shape defined by an inclined guide surface which is inclined relative to an upper surface of the base plate of the base, an upper surface continued from the upper surface of the base plate, and a stopper surface which is at right angles to the upper surface thereof, while each of the second engaging portions has a triangular sectional shape defined by an inclined guide surface and an inclined stopper surface which are inclined relative to the upper surface of the base plate in the reverse direction to each other.

Still further, according to a seventh aspect of the present invention, there is provided a buckle as set forth in the second aspect wherein each of the first engaging portions has a substantially trapezoidal sectional shape defined by an inclined guide surface which is inclined relative to an upper surface of the base plate, an upper surface continued from the upper surface of the base plate, and a stopper surface which is at right angles to the upper surface thereof, while each of the second engaging portions has a circular sectional shape.

The above and many other advantages, features and additional aspects of the present invention will become manifest to those versed in the art upon making reference to the following detailed description and accompanying drawings in which preferred structural embodiments incorporating the principles of the present invention are shown by way of illustrative example.

BRIEF DESCRIPTION OF THE DRAWINGS

FIG. 5 is a fragmentary longitudinally vertical sectional view showing an engaging portion and an engaging piece of the first embodiment shown in FIG. 3, FIGS. 6A to 6C are perspective views showing disassembled parts of the first embodiment shown in FIG. 3 in which

DETAILED DESCRIPTION OF PREFERRED EMBODIMENTS

Hereinafter, the present invention is described in detail with reference to the accompanying drawings (FIG. 3 to FIG. 8B) in which preferred embodiments are shown.

A first embodiment is firstly explained with reference to FIGS. 3 to 6C.

Figure 1:
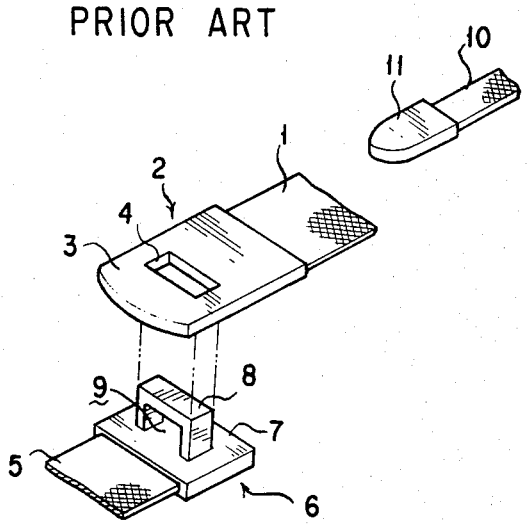
FIG. 1 PRIOR ART
FIG. 1 is a schematic perspective view showing disassembled parts of base, socket and plug which construct a prior art buckle.
Figure 2:
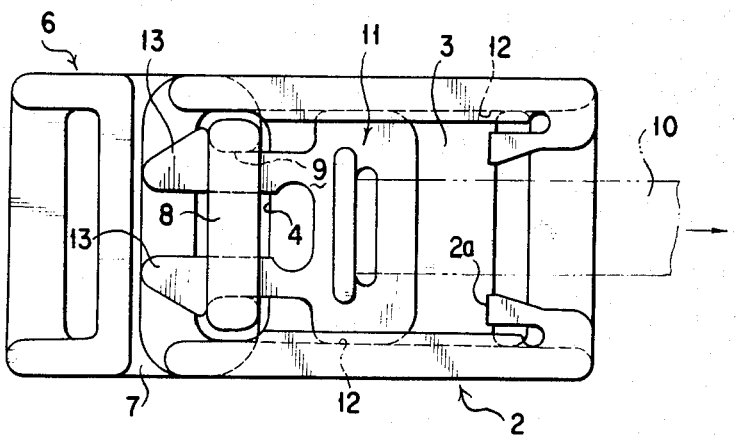
FIG. 2 PRIOR ART
FIG. 2 is a schematic plane view showing another assembled prior art buckle.
Figure 3:
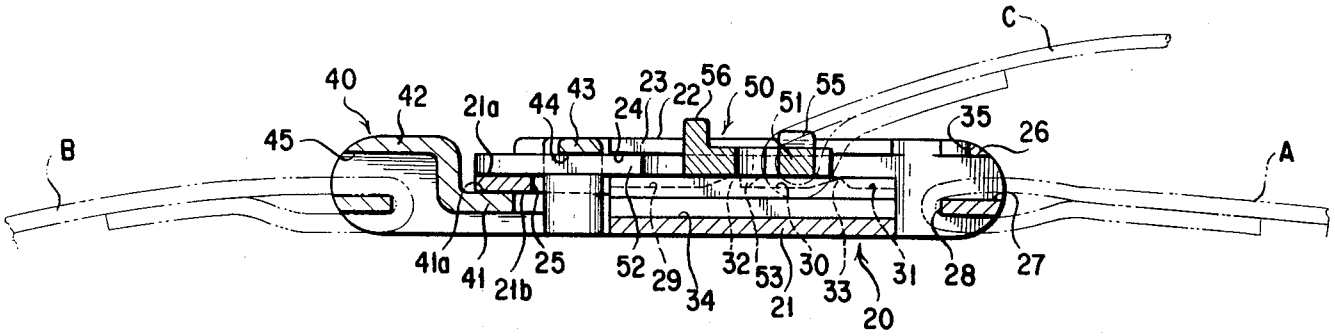
FIG. 3 is a longitudinal and vertical sectional view showing a first embodiment of the present invention.
Figure 4:
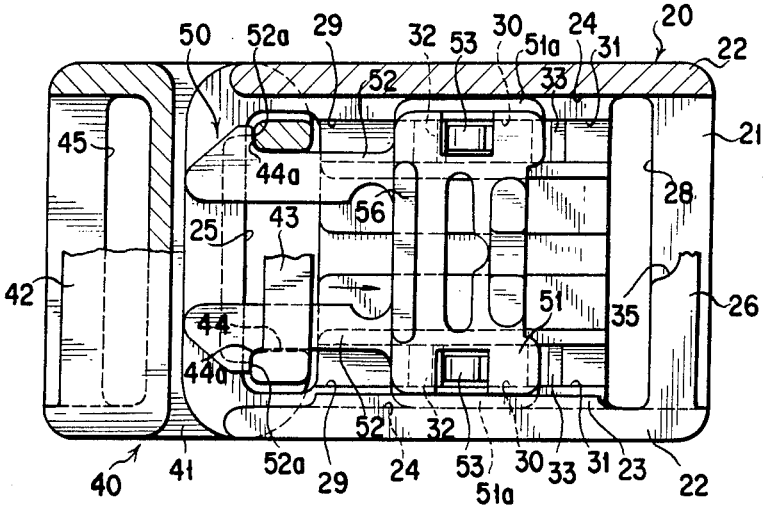
FIG. 4 is a partially broken-away top-plane view of the first embodiment shown in FIG. 3.

The base 20 is comprised of a base plate 21 having opposite rising pieces 22, 22 formed integrally therewith on both sides thereof, the rising pieces 22, 22 each having an inward transverse piece 23 formed integrally therewith on the upper part thereof so as to form opposed U-shaped guide grooves 24. The base plate 21 has a hole 25 formed therein on one end side. The rising pieces 22, 22 on both sides has a transverse connecting member 26 formed integrally therewith so as to connect them on the other end side. A first hole 27 and a second hole 28 for insertion of a belt are formed in the transverse connecting member 26 and the other end of the base plate 21, respectively. The free end of a first belt "A" is inserted in the first and second holes 27, 28 and connected as shown in FIG. 3. The above-mentioned base plate 21 has a first, a second, and a third groove 29, 30 and 31 formed rectilinearly therein at predetermined intervals in the longitudinal direction of the base plate on each side thereof. A first engaging portion 32 is formed between the first and second grooves 29 and 30, whilst a second engaging portion 33 is defined between the second and third grooves 30 and 31.

Figure 5:
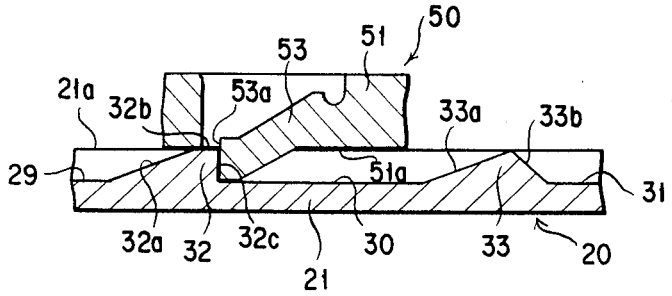
Figure 6A:
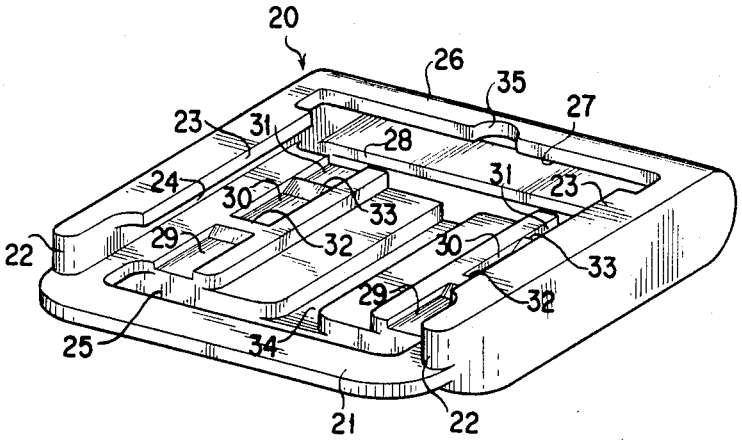
FIG. 6A, 6B and 6 show a base, a plug and a socket, respectively.
Figure 6B:
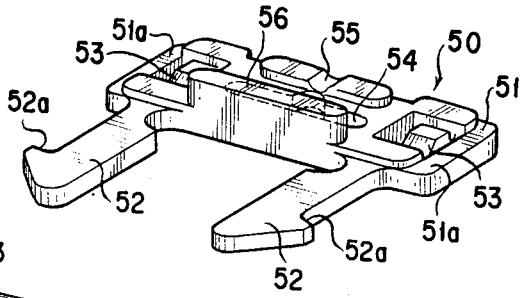
Figure 6C:
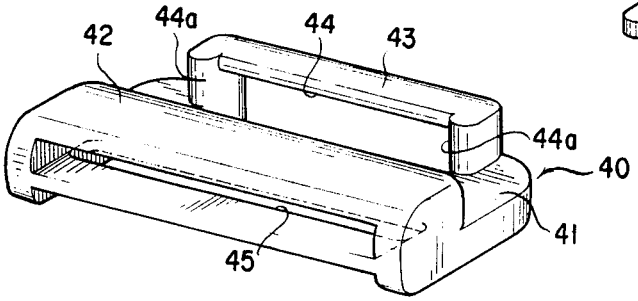

As shown in FIG. 5, the first engaging portion 32 has a substantially trapezoidal sectional shape defined by an inclined guide surface 32*a* which is inclined relative to an upper surface 21*a* of the base plate 21, an upper surface 32*b* continued from the upper surface 21*a*, and a stopper surface 32*c* which is at right angles to the upper surface 32*c*. Whilst, the second engaging portion 33 has a triangular sectional shape defined by an inclined guide surface 33*a* and an inclined stopper surface 33*b* which are inclined relative to the upper surface 21*a* of the base plate 21 in the reverse direction to each other.

Further, the central part of the base plate 21 in the longitudinal direction is downwardly bent stepwise to form a groove 34.

A socket 40 is provided which is comprised of a plate-shaped body 41 having a rising portion 42 formed integrally on one end side thereof, and also having a downward U-shaped projection 43 formed integrally on the other end side so as to form an aperture 44 for insertion of a plug. And, the above-mentioned rising portion 42 has an opening 45 for insertion of a belt, which is formed therein, and in which a second belt B is inserted and connected as shown in FIG. 3.

Further, a plug 50 is provided which is comprised of a plate-shaped base body 51 having a pair of resilient pieces 52, 52 formed integrally therewith in parallel relationship with each other. The pair of resilient pieces 52, 52 has hook-shaped portions 52*a*, 52*a* formed on the leading ends thereof and adapted to engage with the two sides 44*a*, 44*a*, respectively, of the aperture 44. Side portions 51*a*, 51*a* of the above-mentioned plate-shaped base body 51 are adapted to slidably fit in the guide grooves 24 formed on both sides of the above-mentioned base 20. The plate-shaped base body 51 has a pair of engaging pieces 53, 53 formed thereon by protruding downward at respective longitudinal intermediate portions of the plate-shaped base body near both sides thereof. Further, the base body 51 has an opening 54 for insertion of a third belt formed in the longitudinally central part thereof, and also a recess 55 formed therein adjacent to the opening 54. A third belt c is inserted in the opening 54 and connected as shown in FIG. 3. Further, the plug 50 is formed with an upward projection 56 at one end of the plate-shaped base body 51 to facilitate the insertion of the plug 50 into the aperture 44 of the socket 40 by holding the plug by the user's fingers after the socket 40 is engaged with the base 20.

As shown in FIG. 5, each of the above-mentioned engaging pieces 53 is downwardly bent from the plate-shaped base body 51 so as to project downwardly so that it may be, relisiently displaced upwardly and downwardly. Each of the engaging pieces 53 is adapted to be fitted in the first, second and third grooves 29, 30 and 31, and the free end thereof 53*a* is adapted to be engaged with the stopper surface 32*c* of the first engaging portion 32 and the inclined stopper surface 33*b* of the second engaging portion 33. When the plug 50 is mounted on the base 20, the engaging pieces 53 can be slidably moved along the inclined guide surfaces 32*a* of the first engaging portions 32 so that the plug can be elastically deformed and mounted on the base 20.

Thus, when the engaging projection 43 of the socket 40 is fitted in the hole 25 of the base 20, the lower surface 21*b* of the base plate 21 is registered with the upper surface 41*a* of the plate-shaped body 41, and also the aperture 44 is projected upwardly from the upper surface 21*a* of the base plate 21. (Refer to FIG. 3)

When the plug 50 is slidably moved from this state so as to insert the pair of resilient pieces 55 into the aperture 44, it is subjected to an elastic deformation so that the resultant restoring force or reaction force causes the hooked-shaped portions 52*a* to engage with the side portions 44*a* thus locking the plug 50 in the aperture 44 securely so as not to be withdrawn easily. (Refer to FIG. 3)

At that time, the engaging pieces 53 of the plug 50 are abutted against the stopper surface 32*c* of the first engaging portion 32.

This enables the base 20 and the socket 40 to be connected securely by the plug 50. If the third belt c is pulled out from this state so as to slidably move the plug 50 in the direction shown by arrow in FIG. 4, the pair of resilient pieces 52, 52 are subjected to an elastic deformation so that the hook-shaped portions 52*a*, 52*a* are disengaged from the side portions 44*a*, 44*a* to permit sliding of the plug, thus enabling the pair of resilient pieces 52, 52 to be withdrawn from the aperture 44.

When the pair of resilient pieces 52, 52 has been slidably moved out of the hole 25, the engaging pieces 53 of the plug 50 are engaged with the inclined stopper surfaces 33*b* of the second engaging portions 33 so that the plug 50 is held at that position to prevent the bouncing thereof.

At that time, the engaging pieces 53 of the plug 50 are slidably moved along the inclined guide surfaces 33*a* of the second engaging portions 33 while they are being subjected to an elastic deformation.

Further, in case the plug 50 is slidably moved back again from the above-mentioned state, the engaging pieces 53 are slidably moved along the inclined stopper surfaces 33*b* of the second engaging portions 33 while they are being subjected to an elastic deformation.

In this case, it is only necessary to form the second engaging portions 33 in such a shape as to engage with the engaging pieces 53 so as to prevent the bounding of the plug 50 or the withdrawal thereof from the base 20 by the action of its own weight. Therefore, the second engaging pieces 33 may be formed in a circular sectional shape.

Figure 7:
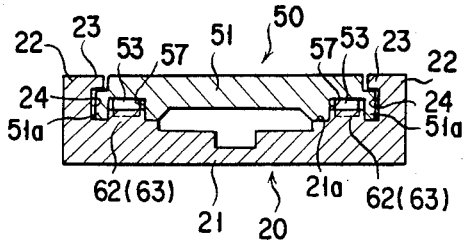
FIG. 7 is a transversely vertical sectional view showing a second embodiment of the present invention.

Although in the above-mentioned first embodiment the first and second engaging portions 32 and 33 are formed so as to flush with the upper surface 21*a* of the base plate 21 and the engaging pieces 53 are formed so as to project downwardly from the plate-shaped base body 51 of the plug 50, it is possible, as shown in FIG. 7 as a second embodiment, to form first and second upward engaging projections 62 and 63 integrally therewith so as to project upwardly from the upper surface 21*a* of the base plate 21, and form downward guide recesses 57, in which the above-mentioned projecting first and second upward engaging projections 62 and 63 are slidably fitted, in the rear surface of the plate-shaped base body 51 of the plug 50, and also form engaging pieces 53 similar to those of the aforementioned embodiment in the guide recesses 57, respectively, so that the engaging pieces 53 can be engaged with the first and the second upwardly engaging projections 62 and 63.

This enables the plug 50 to be slidably guided by the first and second upwardly engaging projections 62 and 63, and the guide recesses 57.

Figure 8A:
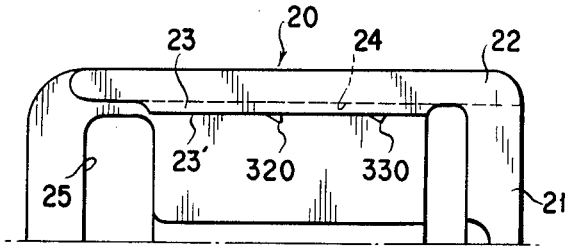
FIGS. 8A and 8B are fragmental plane views showing disassembled plug and socket of a third embodiment of the present invention.
Figure 8B:
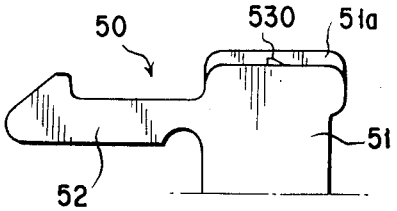

Further, as shown in FIG. 8A, it is possible to form first and second engaging projections 320 and 330 on inward side faces 23' of the inward projection pieces 23 forming the guide grooves 24 of the base 20, respectively, and also, as shown in FIG. 8B, form engaging pieces 530 on the both side faces of the plate-shaped base plate 51 of the plug 50, respectively, so as to engage with the first and the second engaging projections 320 and 330 of the base 20.

Still further, the height of the guide grooves in the base 20 may be tapered or reduced from the side of the hole 25 to the first and second holes 27 and 28 for insertion of the belt.

Stating in brief, it is only necessary to form the sliding portions of the base 20 and the plug in such a configuration as to increase the resistance to sliding of the plug on the base when the resilient pieces 52 of the plug 50 has slidably moved out of the hole 25.

Although, in the above-mentioned embodiments, the first engaging portions 32 (or 62 or 320) are provided to prevent the plug 50 from withdrawing from the base 20, the withdrawal may be prevented by the second engaging portions 33 (or 63 or 330) and the first engaging portions 32 (or 62 or 320) may be omitted.

Further, in the aforementioned embodiments, the third belt c is of a band shape, but it may be formed in a string-like shape having a substantially circular section. In that case, the third belt c can be fitted in the recess 55 formed in the plate-shaped base body 51 of the plug 50 so as to prevent the swinging thereof, and the third belt c is passed through the groove 34 formed in the base plate 21 of the base 20 and through a notched groove 35 so that the plug 50 may be slidably moved smoothly.

What is claimed is:

1. A buckle comprising:

(a) a base consisting of a base plate having an open hole formed therein on the longitudinal one end side thereof, a portion for connecting a first belt, said first belt connecting portion being formed in the base plate on the other end side thereof, and opposite rising pieces formed integrally therewith on both sides thereof, each rising piece having an inward projection piece formed integrally with said rising piece on the uppermost part thereof so as to form a guide groove thereat;

(b) a socket consisting of a plate-shaped body having a portion for connecting a second belt, said second belt connecting portion being formed in the plate-shaped body on one end thereof, and a projection formed integrally with the plate-shaped body on the other end side thereof, said projection being fitted in said hole formed in the base plate and having an aperture formed therein so as to be parallel to an upper surface of the plate-shaped body; and (c) a plug consisting of a plate-shaped base body adapted to be slidably moved along said guide grooves formed at both sides of the base and having resilient pieces formed integrally therewith an extending from one end thereof, the resilient pieces being adapted to be engaged with said aperture of the socket in snap-fit fashion and disengaged therefrom, and further having a portion for connecting a third belt, the third belt connecting portion being formed in said plate-shaped base body on the other end side thereof;

(d) said base plate of the base further having first, second and third grooves formed respectively in positions therein at both sides thereof, said grooves in each side being rectilinearly arranged at predetermined intervals in the longitudinal direction of said base plate, a first engaging portion formed between said first groove and said second groove, and a second engaging portion formed between the second groove and said third groove, and wherein said plug further comprises a pair of engaging pieces at both sides of said plate-shaped base body thereof, respectively, each engaging piece being formed at a longitudinally intermediate portion of the plate-shaped base body and projecting downwards so as to be slidably inserted into said first, second and third grooves of said base plate of the base and engaged with said first and second engaging portions of the base plate;

wherein the respective sliding portions of the base and the plug are arranged such that the resistance to sliding of the plug on the base becomes large when the resilient pieces of the plug are located out of the hole formed in the base.

2. A buckle as set forth in claim 1 wherein said base plate further has first and second engaging projections formed integrally on inward side surfaces of said inward projection pieces of the rising pieces thereof forming said guide grooves of the base, respectively, said engaging projections in each side being arranged in positions at predetermined intervals in the longitudinal direction of the base plate, and wherein said plug is further provided with engaging pieces formed integrally in positions on both side end faces of the plate-shaped base body of the plug, respectively, so as to engage with the first and second engaging projections of the base plate.

3. A buckle as set forth in claim 1 wherein said plug is still further provided with an upward projection to facilitate the insertion of the plug into said aperture formed in the socket by holding the plug by user's fingers after the socket is engaged with the base, said upward projection being formed at one end of the plate-shaped base body.

4. A buckle as set forth in claim 1 wherein each of said first engaging portions has a substantially trapezoidal section shape defined by an inclined guide surface which is inclined relative to an upper surface of the base plate of the base, an upper surface continued from the upper surface of the base plate, and a stopper surface which is at right angles to the upper surface thereof, while each of said second engaging portions has a triangular sectional shape defined by an inclined guide surface and an inclined stopper surface which are inclined relative to the upper surface of the base plate in the reverse direction to each other.

5. A buckle as set forth in claim 1 wherein each of said first engaging portions has a substantially trapezoidal sectional shape defined by an inclined guide surface which is inclined relative to an upper surface of the base plate, an upper surface continued from the upper surface of the base plate, and a stopper surface which is at right angles to the upper surface thereof, while each of said second engaging portions has a circular sectional shape.

6. A buckle comprising:

(a) a base consisting of a base plate having an open hole formed therein on the longitudinal one end side thereof, a portion for connecting a first belt, said first belt connecting portion being formed in the base plate on the other end side thereof, and opposite rising pieces formed integrally therewith on both sides thereof, each rising piece having an inward projection piece formed integrally with said rising piece on the uppermost part thereof so as to form a guide groove thereat;

(b) a socket consisting of a plate-shaped body having a portion for connecting a second belt, said second belt connecting portion being formed in the plate-shaped body on one end thereof, and a projection formed integrally with the plate-shaped body on the other end side thereof, said projection being fitted in said hole formed in the base plate and having an aperture formed therein so as to be parallel to an upper surface of the plate-shaped body; and (c) a pug consisting of a plate-shaped base body adapted to be slidably moved along said guide grooves formed at both sides of the base and having a resilient pieces formed integrally therewith an extending from one end thereof, the resilient pieces being adapted to be engaged with said aperture of the socket in snap-fit fashion and disengaged therefrom, and further having a portion for connecting a third belt, the third belt connecting portion being formed in said plate-shaped base body on the other end side thereof;

said base plate of the base further having first and second upwardly engaging projections formed respectively thereon at both sides thereof, said engaging projections in each side being arranged in series and at predetermined intervals in the longitudinal direction of the base plate and upwardly projecting integrally from the upper surface of the base plate, and wherein said plug is further provided with downward guide recesses formed in lower surfaces at both sides of the plate-shaped base body of the plug, each downward guide recess being slidably engaged with said first and second upward engaging projections of the base plate, and engaging pieces formed in positions in said downward guide recesses, respectively, and integrally projecting downwards from the plate-shaped base body so as to engage with the first and the second upward engaging projections of the base plate;

wherein the respective sliding portions of the base and the plug are arranged such that the resistance to sliding of the plug on the base becomes large when the resilient pieces of the plug are located out of the hole formed in the base.

* * * * *